US005394924A

United States Patent [19]

Rejc

[11] Patent Number: 5,394,924

[45] Date of Patent: Mar. 7, 1995

[54] CLOSURE ELEMENT FOR AN APERTURE

[76] Inventor: Gabrijel Rejc, Falkenstr. 46, Landshut, Germany

[21] Appl. No.: 38,960

[22] Filed: Nov. 10, 1992

[51] Int. Cl.[6] ..... E05D 15/26

[52] U.S. Cl. ..... 160/201; 160/40

[58] Field of Search ..... 160/201, 229.1, 40, 160/196.1, 199, 206, 207, 231.1, 231.2

[56] References Cited

U.S. PATENT DOCUMENTS 2,214,653 9/1940 Barlough ..... 160/201
3,148,724 9/1964 Chieger et al. ..... 160/201 X
3,302,690 2/1967 Hurd ..... 160/201 X
3,608,613 9/1971 Halliwell ..... 160/201 X
3,891,021 6/1975 Geoffrey ..... 160/201 X
4,893,666 1/1990 Hormann ..... 160/201 X

*Primary Examiner*—David M. Purol
*Attorney, Agent, or Firm*—Nixon & Vanderhye

[57] ABSTRACT

The closure of the invention for an aperture has strips interlinked articulatedly via hinges in such a way that the distance between adjacent strips defines a space in which the hinge pins engage. Rubber sealing strips are fitted to interconnect adjacent strips; they are arranged coaxially with the hinge pins and engage with the strips virtually without any clearance.

7 Claims, 3 Drawing Sheets

CLOSURE ELEMENT FOR AN APERTURE

BACKGROUND OF THE INVENTION

The invention relates to a closure element for an aperture which can be moved from a closing or closed position into an open position of the aperture.

Such a closure element is known per se in a horizontally movable rolling door. See, for example, U.S. Pat. No. 2,092,534.

In DE-A-3 244 743, a rolling wall for refrigerating and insulating containers is also known. The rolling wall consists of a heat insulating material and is provided with heat insulated compound profiles made of light metal. The compound profiles are equipped at their adjacent longitudinal edges with respectively undercut grooves. For the connection of facing slats, a connecting strap produced from rubber or from a correspondingly elastic material is provided which interlockingly engages the undercut grooves of the compound profiles.

It is also known from U.S. Pat. No. 3,033,284 to utilize hinge straps for an angling connection of the slats in a rolling door.

A further known example of such a closure element for an aperture is a rolling armor of a rolling door functioning as a vertically opening closure of a walk-through or drive-through door aperture, consisting of slats which can be angled relative to one another and which are guided into the closing position on the two side edges of the door aperture by means of vertical guide rails, said rolling armor being moved up into the open position and wound by means of a winding shaft to which the rolling armor is fastened.

The rolling armor, functioning as the part of a rolling closure which closes off and protects the door aperture, consists of slats, typically profiled parts, for example extruded aluminum materials, connected to one another in an articulated manner. The height of the individual slats is, usually approximately 80 to 120 mm.

These profiled parts are usually provided as push-in profiles which, by virtue of their shape, are connected to one another in an articulated manner, without further connection members, to form the rolling armor. In a typical aluminum extruded profile, the joint is designed, for example, as a cup and web, so that, with the profiles pushed into one another, the joint thus formed can absorb and withstand the forces which occur when the rolling armor is being wound up. Typically, the connection of the slats which is shaped to form a joint has a large play. Moreover, the shape, with the profiles pushed into one another, should be designed so that dirt and water are prevented from settling in the joints and sufficient sealing against wind is guaranteed.

Furthermore, closure elements for an aperture are known in so-called sectional doors which are likewise used for large door apertures. The conventional sectional door consists essentially of an armor having comparatively high sections which can be folded out of a vertical closing position into an upper horizontal position underneath the ceiling by means of a cable drive.

The comparatively large height of the individual sections which is used in sectional doors ensures, as a result of the reduced number of connecting elements for the sections, such as hinges or the like, and also a reduction in the number of end faces to be sealed off, a mechanically altogether more compact design, with correspondingly better strength against attack by wind and safety against unauthorized opening. Moreover, the large height of the individual sections makes it possible to provide transparent portions in the form of glass or plastic windows.

As a rule, in the closing position, the individual sections lie in alignment on one another, so that the entire end face of the particular section is available for the sealing. The sectional door thus appears as a fully closed door having a continuous outer surface, without intermediate gaps. Further improved sealing is brought about, for example, by rubber inserts which, in the closing position, are compressed by the sections lying above one another. Alternatively, the sections have a bulge which extends on one end face over the entire door width and which, when the sections are being pivoted into the same plane, engage into a corresponding depression of an adjacent section in the manner of a tongue-and-groove joint, thereby further improving the mechanical strength of the door leaf against wind pressure, even where large door widths are concerned.

On the inside of the door, the sections are connected by means of a plurality of individual hinges which are attached over the entire width of the door at particular intervals in such a number that sufficiently high strength and support is achieved. The hinges attached to the lateral edge of the sections are, as a rule, designed the same as a holder for a roller which can run in a guide rail of U-shape cross-section on the edge region of the sectional door. Since the individual hinges are attached to the sections in such a way that the sections can be folded away towards the inside, problems also arise here inasmuch as the parts of the hinges which are attached to the inside of the door and which project are visually displeasing and may cause injury. A further danger of injury in sectional doors is caused during the angling of the sections, by the open gaps occurring thereby, or during the folding back of the sections and the closing of the gaps.

SUMMARY OF THE INVENTION

The object on which the invention is based is to provide a closure element for a door aperture, which, in the closed state, offers sufficient sealing against attack by wind and weather and high stability even against pressure loading at particular points.

The closure element according to the present invention has slats which are connected to one another in an articulated manner by means of hinges, in such a way that the distance between respective adjacent slats forms a space, into which the hinge pins of the hinges engage. By providing the pivot axis of each hinge within the space between the slats, the angle angular between the adjacent slats and also the tilting accelerations during the movement of the closure element into the open position are minimized, with correspondingly lower acceleration forces during the angling of the closure element, with the result that a low-wear guidance within narrow radii becomes possible and a correspondingly small amount of space is required in the open position, without, the expense of the generation of an increased amount of noise during the opening and closing. Furthermore, projecting parts of the hinge are avoided, with a corresponding visual effect and reduction of the danger of injury. Adjacent slats are respectively provided, approximately over the entire width of the aperture, with sealing strips which ensure sealing against wind and which prevent rainwater and dust from penetrating. The sealing strips are arranged in such a way that the geometrical axis of the hinge pins comes to rest within the contour of the sealing strip, so that, during the angling of the closure element, the sealing strips are subjected only to bending load. The sealing strips have, on the mutually opposite sides, beads or thickenings which engage into correspondingly shaped recesses of the slats, mutually confronting supporting faces of the thickenings being at a minimum distance, but allowing fault-free mounting, from corresponding holding faces of the slats, so that, in the closing position of the closure element, when a slat is subjected to pressure transversely to the door plane—after initial restoring forces solely as a result of bending stress on the sealing strips relative to the adjacent slats—there immediately occurs a tensile stress on the sealing strips which prevents or limits a further bending out in relation to adjacent slats. The closure element thus behaves as a whole largely in the same way as a homogeneous plane plate, with a corresponding force distribution in the plate plane, but nevertheless has the possibility of being guided round or wound up with low force.

The closure element according to the invention can be used as a closure for any desired types of door apertures. The aperture can be vertical in the form of a door or window aperture or also horizontal, for example in the form of an aperture of a swimming pool or the like. The closure element can be guided by means of guide tracks, with the result that higher running speeds, with less noise being generated, become possible during the opening and closing, or can be wound up without any guidance. The closure element can be driven via an electric motor or even manually.

An especially high-speed running during the closing and opening of the closure element becomes possible when the hinges are in the form of hinge straps, with hinge members which are connected to one another in an articulated manner and which can be angled relative to one another via the hinge pins, the hinge straps having a length corresponding to the clear height of the aperture. These hinge straps form the supporting structure of the closure element, since all the pulls are absorbed by the hinge straps and are not transmitted into the slats.

According to another aspect of the invention, the sealing strips are preferably produced from an elastic material, especially from rubber, with the result that movable mechanical parts for the angling are avoided and only little effort is required in order to angle the closure element additionally the noises occurring during the angling are kept as low as possible.

An even quieter running of the slatted armor, which is approximately free of frictional forces and which is therefore faster, is achieved in that rollers are mounted coaxially relative to the hinge pins and run in corresponding guide tracks.

An especially sealing closure of the door aperture is obtained when there is provided on the outside of each slat a sealing nose, by means of which the distance between adjacent slats in the closing position is reduced, but without the slats themselves touching one another. Since the sealing strips can thereby no longer be seen from outside, a pleasing external appearance of the closure element in the form of a uniformly smooth surface is obtained at the same time.

Holding collars for securing the position of the slats maybe arranged on the two mutually opposite sides of the closure element, in the closing position the closure element can counteract even relatively high pressure forces, without the fear that the closure element will be pulled out of the aperture.

Further details and expedient features of the invention emerge from the following description of an embodiment with reference to the Figures.

BRIEF DESCRIPTION OF THE DRAWING FIGURES

DESCRIPTION OF A PREFERRED EMBODIMENT

The below-described exemplary embodiment of a closure element according to the invention is given with reference to its use as a lifting door which is movable vertically upwards from a closing position into an open position of a door aperture. To that extent, attention is drawn to and reference is made to the full content of the two parallel German Patent Applications of applicant, entitled "Lifting door with a slatted armor having anglable slats" (11EF01412) and "Lifting door with a slatted armor in guide tracks" (11EF01422). However, the present closure element is in no way restricted to use in a lifting door, but can also be employed in any door apertures for.

Figure 1:
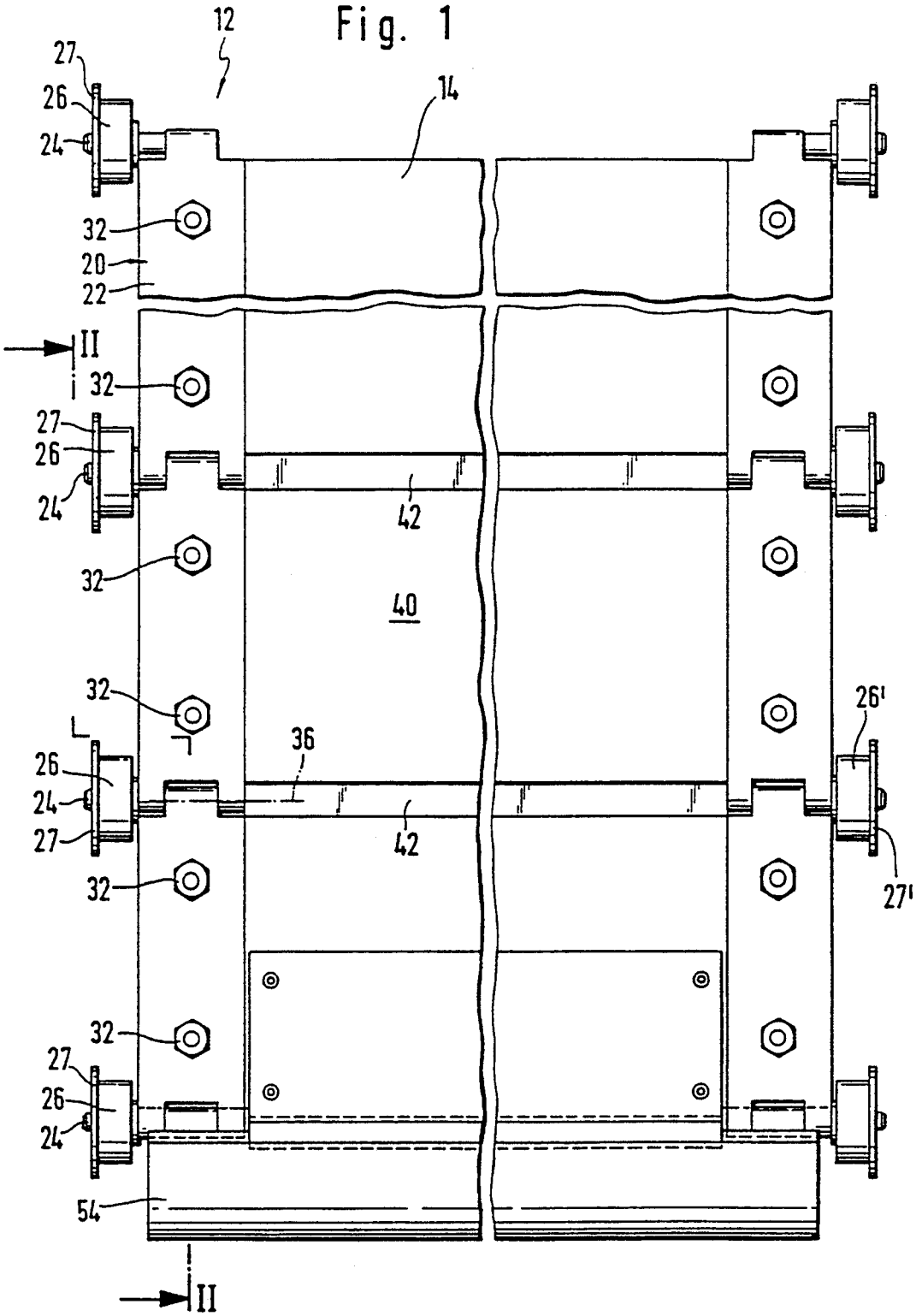
FIG. 1 shows a rear view of a closure element corresponding to an exemplary embodiment according to the invention.
Figure 2:
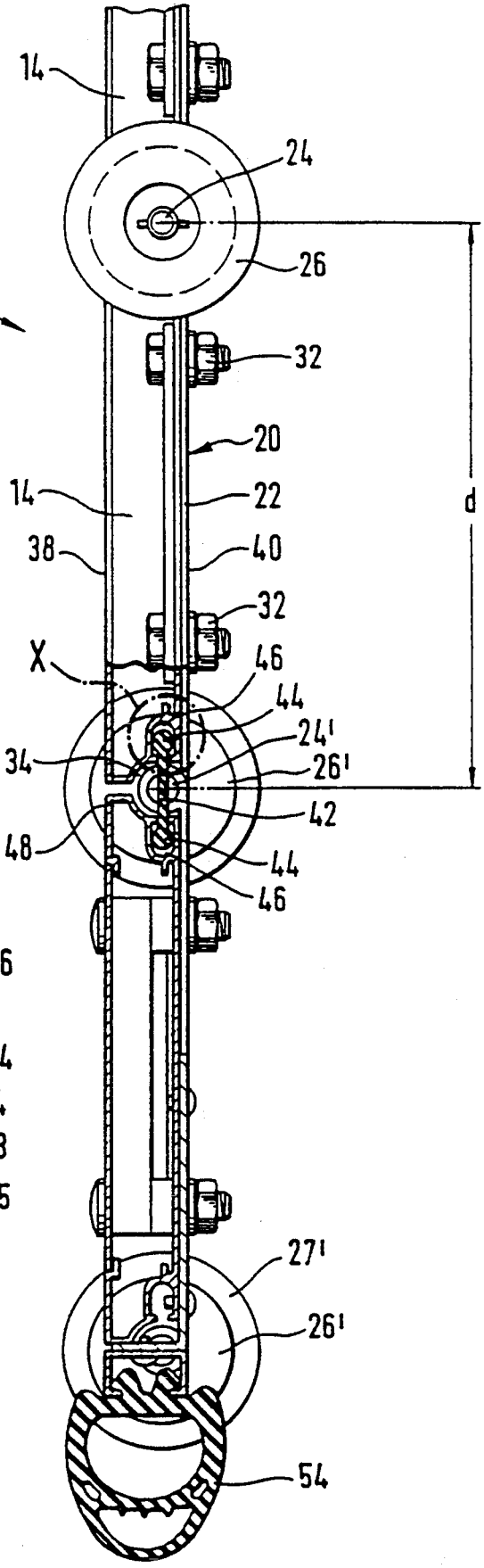
FIG. 2 shows a diagrammatic sectional representation along the line II—II in FIG. 1.
Figure 3:
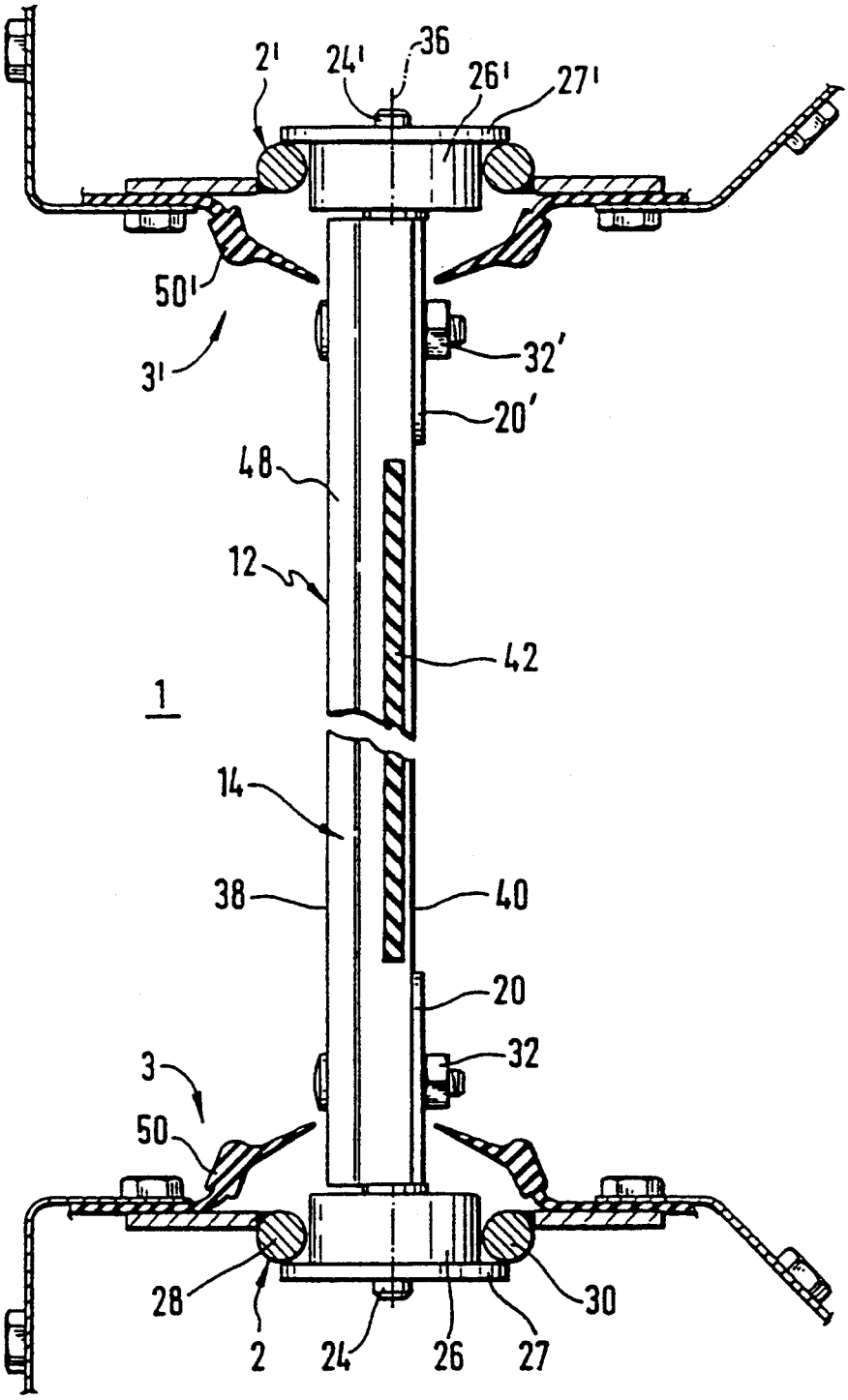
FIG. 3 shows a top view of a closure element according to the present invention, the closure element being used on a lifting door to be moved vertically upwards.

As represented in FIGS. 1 to 3, the illustrated embodiment of a closure element 12 according to the invention for an aperture 1 has a plurality of slats 14 for covering the aperture 1, the slats being connected to one another in an articulated manner by means of hinges 20, 20'. Mutually opposite sides of adjacent slats are respectively connected via sealing strips 42, as is also described in detail below. The illustrated closure element is, according to FIG. 3, guided on the two mutually opposite sides 3 and 3' of the door aperture 1 by means of guide tracks 2 and 2', so that the closure element 12 is movable from the vertical closing position into an open position in region outside the aperture 1. Reference symbols bearing the simple quotation mark denotes respective corresponding parts of the closure element which are arranged on the side 3' of the aperture 1 and which constitute the mirror-symmetrically corresponding parts of the reference symbols not bearing the simple quotation mark.

Provided on the two edge sides of the closure element 12 are respective hinges in the form of hinge straps 20, 20' which have a length corresponding essentially to the height of the door aperture 1. Each hinge strap 20, 20' consists of rigid hinge members 22 which are connected to one another in an articulated manner and which can be angled relative to one another via hinge pins 24, 24'. For this purpose, each hinge member is shaped at its end in a known way to form a rolled-round lug, into which the hinge pin 24 can be inserted. Two respective adjacent hinge members are connected to one another in an articulated manner, in such a way that their lugs are arranged coaxially relative to one another, a common hinge pin 24 being mounted in these lugs.

Furthermore, in the example illustrated, rollers 26, 26' are mounted coaxially relative to the hinge pins 24, 24' and serve for the rolling guidance of the hinge straps 20 and 20' in the guide tracks 2 and respectively. In the example illustrated, each guide track has a pair of round bars 28 and 30 which are arranged at a uniform distance from one another which is selected to match the diameter of the rollers 26. The hinge straps 20, 20' and the round bars 28, 30 are produced, for example, from hard metallic material, whilst the rollers 26 can also be produced from plastic material. To prevent the individual slats 14 and therefore the closure element from being pulled out of the guide track, each roller 26, 26' has a holding collar 27, 27', the outside diameter of which is larger than the clear distance between the round bars 28, 30.

The slats 14 are attached and fastened to the hinge straps 20, 20', for example by means of screw connections 32, 32', in such a way that the resulting distance between the respective adjacent slats 14 forms a space 34, into which engage the hinge pins 24, 24' or the lugs surrounding the hinge pins and belonging to the hinge members 22, 22', as is best shown in FIG. 2. This is achieved, according to the invention, in that the geometrical axis of articulation 36 lies completely within the region which is limited by the two outer main surfaces 38 and 40 of the closure element 12. This position of the axis of articulation 36 ensures that the width of the angle opening between the adjacent slats 14 during articulation of the closure element is reduced to a minimum, so that the angular accelerations during entry into an upper bent guide track outside the region of the aperture 1 are correspondingly reduced. The possible running speeds of the closure element shown are thereby further increased, without this being accompanied by the generation of an excessive amount of noise.

The slats, of a height of, for example, up to 150 mm, are attached to the hinge straps 20, 20' completely independently of one another and individually, so that, for example, the absence of an entire slat entails no effects on the mechanical stability and functioning of the closure element. The hinge straps 20 and 20' thus form as it were the supporting structure or skeleton of the closure element which absorbs all the forces occurring during the movement of the lifting door. Because of the mechanically continuous cohesion of the hinge strap 20, 20', the pulls occurring are absorbed by the hinge straps 20, 20' and are not transmitted to the slats 14. As a result of the transmission and distribution of the occurring forces to an articulated continuous, but tension-resistant strap, a uniform and steady cycle of movement is achieved, even when the lifting door runs at extremely high speed.

Since the individual slats 14 are initially attached to the hinge straps 20, 20' at a particular distance from one another, in order thereby to make room for the hinge pin, the adjacent slats 14 are not in contact with one another, even in the closing position of the closure element, with the result that the rattling noises known in the conventional sectional door during the closing of the door are also completely eliminated here.

Figure 2A:
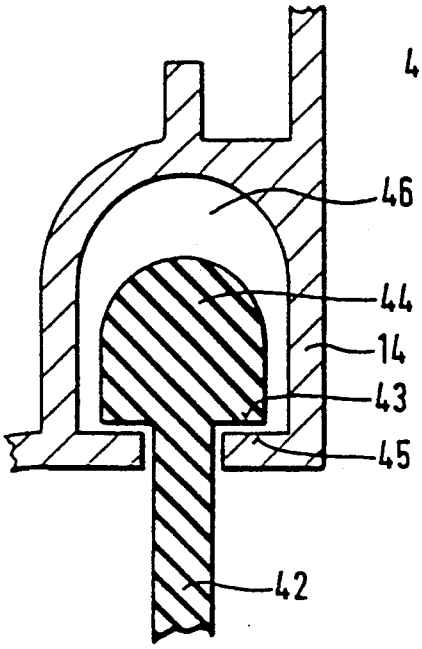
FIG. 2A shows diagrammatically an enlarged representation of the detail X of FIG. 2.

To reinforce the mechanical stability of the slatted armor and to increase the sealing, but without putting at risk the properties of the present closure element in terms of low noise generation, there are provided sealing strips 42 in the form of rubber strips which are arranged approximately over the entire door width between the hinge straps 20 and 20' and which connect mutually opposite sides of adjacent slats 14. Each sealing strip 42 is arranged coaxially relative to the adjacent axis of articulation 36, so that, during the angling of the slatted armor 12, the sealing strips 42 are subjected only to bending load in the guide region (not shown) outside the aperture. Each sealing strip 42 possesses, on opposite sides, beads or thickenings 44 which engage into correspondingly shaped recesses 46 of the slats 14. As can best be seen from the enlarged cut-out according to FIG. 2A, each thickening 44 has a supporting face 43 which is arranged opposite a corresponding holding face 45 of the slat 14. The distance between a supporting face 43 and the respective associated holding face 45 of the slat 14 is selected as small as possible—allowing for the requirement of jam-free and fault-free mounting by the insertion of the sealing strip 42 with the thickening 44 into the recess 46 from the side—', so that, in the closing position of the closure element, pressure loads possibly occurring on the closure element result in the sealing strip 42 being tilted to the side and, after the start of contact of the supporting face 43 with the holding face 45, in the sealing strip 42 being subjected to tensile stress relative to the two adjacent slats. In the event of even smaller deflections of the slat in question out of the plane of the door leaf, that is to say as long as the supporting face 43 does not touch the opposite holding face 45, the sealing strip 42 is subjected only to bending stress relative to the two adjacent slats, thus leading to corresponding restoring forces. Since the distance between the supporting face 43 and the associated holding face 45 is selected at a minimum, even when only small deflections occur, to obtain a tensile stress on the sealing strip, the pressure loads occurring on the closure element are thus also transmitted and distributed from the initially directly affected sealing strip 42 to the adjacent sealing strips. Under pressure load, therefore, the closure element according to the invention behaves largely in the same way as the homogeneous plane plate, with corresponding force distribution in the plate plane, but nevertheless its slants have the possibility of being articulated with minimum force. The sealing strips 42 consequently bring about an appreciable increase in the mechanical stability of the closure element, so that, in the closing position, the entire closure element easily withstands even high wind loads or other pressure loads. The, the closure element according to the invention also affords sufficient safety against unauthorized opening, so that the closure element according to the invention can be considered as a permanent closure of an aperture.

To prevent the closure element 12 from being pulled out, should even higher pressure forces possibly occur, there are arranged, on the two opposite sides of the closure element, holding collars 27, 27' which, in the exemplary embodiment illustrated, are designed as an outer disk having a larger diameter than the diameter of the rollers 26, 26'. The holding collars 27, 27' are arranged at small distances from adjacent supporting faces of the guide bars 28, 30, in such a way that they come up against the outside of the guide bars 28, 30 to provide support, only when the slats 14 bend very sharply under load, so that the closure element remains easily actuable and movable under relatively low pressure loads. The above-described force distribution via the sealing strip 42 in the plane of the door, even under load at particular points, prevents the holding collars 27, 27' of a loaded slat 14 from providing support prematurely as a result of the sharp bending out of the latter and from thereby impeding the movement of the closure element.

In the exemplary embodiment shown according to FIG. 2, each slat 14 has a sealing nose 48 which projects on the outside 38 in the plane of the door leaf and by means of which the distance from an adjacent slat is reduced. Because of the sealing nose 48, the rubber strip 42 can no longer be seen from outside in the closing position. The rubber strip 42 is then still visible only from the inside (see the rear view according to FIG. 1). At the same time, as a result of the design of the sealing nose 48, as shown in FIG. 2, a more pleasing appearance of the slatted armor 12 in the form of a more uniform smooth surface is obtained.

To seal off the closure element relative to the ground, according to FIGS. 1 and 2, a closure 54, for example made of rubber, is provided and is fastened to the lowest slat.

I claim:

1. A closure element for an aperture comprising:

a plurality of slats spaced from one another and lying in a plane in the aperture;

hinges connecting between adjacent slats maintaining spaces between said slats and including hinge pins disposed in said spaces between adjacent slats and defining articulation axes for pivotal movement of said slats from said plane;

sealing strips coupled between adjacent slats and disposed in said spaces to in part lie on said axes;

said sealing strips having a central portion and enlarged portions on opposite sides of said central portion with supporting faces;

said adjacent slats having opposed recesses on opposite sides of said spaces with a sealing strip holding face in each recess, said enlarged portions being receivable in said recesses, with said supporting faces of said sealing strips and said holding faces of said adjacent slats being spaced a predetermined distance from one another when said slats lie in said plane.

2. A closure element according to claim 1, wherein said hinges comprise straps having a length corresponding to the combined extent of the slats and the spaces therebetween thereby corresponding in length substantially to the full extent of the aperture in said plane and extending in a direction normal to said axes.

3. A closure element according to claim 1, wherein said sealing strips are formed of an elastic material.

4. A closure element according to claim 3, wherein said material is rubber.

5. A closure element according to claim 1, including guide tracks on opposite ends of said slats, and rollers carried by said slats coaxially relative to said hinge pins for rolling guidance along said guide tracks.

6. A closure element according to claim 1, including a sealing nose carried by at least one slat of adjacent slats in said space and located to one side of said articulation axis whereby the sealing nose reduces the distance between the adjacent slats.

7. A closure element according to claim 1, including holding collars on opposite sides of said closure element and rollers carried by said pins coaxially of said articulated axes for locating said slats.

* * * * *

UNITED STATES PATENT AND TRADEMARK OFFICE

CERTIFICATE OF CORRECTION

PATENT NO. : 5,394,924
DATED : March 7, 1995
INVENTOR(S) : Gabrijel Rejc

It is certified that error appears in the above-identified patent and that said letters patent is hereby corrected as shown below:

On title page, insert as item numbered [30] the following:

--[30] Foreign Application Priority Data
May 13, 1991 ..... PCT/EP91/00886
May 11, 1990 [DE] Fed. Rep. of Germany ..... P40 15 216.2--

Signed and Sealed this

Twenty-sixth Day of March, 1996

*Attest:*

*Attesting Officer*

BRUCE LEHMAN

*Commissioner of Patents and Trademarks*